US008522682B1

(12) United States Patent
Genson et al.

(10) Patent No.: US 8,522,682 B1
(45) Date of Patent: Sep. 3, 2013

(54) ADVANCED GRENADE CONCEPT WITH NOVEL PLACEMENT OF MEMS FUZING TECHNOLOGY

(75) Inventors: Kevin Genson, College Park, MD (US); Daniel Jean, Odenton, MD (US); John Hendershot, Dunkirk, MD (US); Gerald Laib, Olney, MD (US); David Olson, Chesapeake beach, MD (US); Ezra Chen, Potomac, MD (US); Veronica Badescu, Alexandria, VA (US); Anthony Mansfield, Alexandria, VA (US); Troy Caruso, Alexandria, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 282 days.

(21) Appl. No.: 12/924,797

(22) Filed: Sep. 23, 2010

(51) Int. Cl.

| | |
|---|---|
| ***F42C 15/184*** | (2006.01) |
| ***F42C 15/40*** | (2006.01) |
| ***F42C 15/24*** | (2006.01) |
| ***F42C 15/22*** | (2006.01) |

(52) U.S. Cl.
USPC ..... 102/221; 102/476; 102/488; 102/306; 102/275.9

(58) Field of Classification Search
USPC ..... 102/221, 275.9, 306, 476, 482, 487, 102/488
See application file for complete search history.

(56) References Cited

U.S. PATENT DOCUMENTS

| | | | | | |
|---|---|---|---|---|---|
| 4,444,116 | A * | 4/1984 | Mitard et al. | ..... | 102/476 |
| 4,567,829 | A * | 2/1986 | Ziemba et al. | ..... | 102/211 |
| 4,598,884 | A * | 7/1986 | Speer | ..... | 244/3.16 |
| H000344 | H * | 10/1987 | Williamsen et al. | ..... | 102/476 |
| 4,938,146 | A * | 7/1990 | Gunther et al. | ..... | 102/439 |
| 4,969,397 | A * | 11/1990 | Gunther et al. | ..... | 102/233 |
| 4,982,665 | A * | 1/1991 | Sewell et al. | ..... | 102/306 |
| 5,081,929 | A | 1/1992 | Mertens | | |
| 5,157,221 | A * | 10/1992 | Ronn | ..... | 102/216 |
| 5,166,469 | A * | 11/1992 | Kerdraon et al. | ..... | 102/210 |
| 5,275,107 | A * | 1/1994 | Weber et al. | ..... | 102/251 |
| 6,167,809 | B1 * | 1/2001 | Robinson et al. | ..... | 102/235 |
| 6,622,629 | B2 | 9/2003 | Hodge et al. | | |
| 6,857,372 | B2 * | 2/2005 | Renaud-Bezot et al. | ..... | 102/493 |
| 6,964,231 | B1 * | 11/2005 | Robinson et al. | ..... | 102/235 |
| 7,040,234 | B1 | 5/2006 | Maurere et al. | | |
| 7,055,437 | B1 | 6/2006 | Robinson et al. | | |
| 7,316,186 | B1 * | 1/2008 | Robinson et al. | ..... | 102/251 |
| 7,490,552 | B1 | 2/2009 | Jean et al. | | |
| 7,506,586 | B1 * | 3/2009 | Pereira et al. | ..... | 102/207 |
| 7,552,681 | B1 | 6/2009 | Laib et al. | | |
| 7,654,458 | B1 * | 2/2010 | Kokodis et al. | ..... | 235/400 |
| 7,808,158 | B1 * | 10/2010 | Deeds et al. | ..... | 310/339 |
| 7,913,623 | B1 * | 3/2011 | Fan et al. | ..... | 102/254 |
| 7,971,532 | B1 * | 7/2011 | Olson et al. | ..... | 102/254 |

(Continued)

*Primary Examiner* — Bret Hayes
*Assistant Examiner* — Derrick Morgan
(74) *Attorney, Agent, or Firm* — Fedric J. Zimmerman

(57) ABSTRACT

The present disclosure relates to systems and methods for explosive systems such as grenades with novel micro-electromechanical systems (MEMS) fuze and novel placement of the MEMS fuze providing increased performance, reliability, and safety. The MEMS fuze is disposed towards a rear portion of the explosive system providing superior performance and design flexibility. Further, the explosive system includes electronics configured to implement a launch timer and to sense impact or when the system stops spinning. The present invention includes an operational method improving safety and reliability by preventing detonation until after the launch timer expires, upon impact, or when the explosive system stops spinning.

18 Claims, 5 Drawing Sheets

(56) References Cited

U.S. PATENT DOCUMENTS

| | | | | |
|---|---|---|---|---|
| 8,091,478 | B1 * | 1/2012 | Khuc et al. | 102/304 |
| 8,220,395 | B1 * | 7/2012 | Gorman et al. | 102/482 |
| 8,266,963 | B2 * | 9/2012 | Rastegar et al. | 73/514.34 |
| 8,276,515 | B1 * | 10/2012 | Robinson et al. | 102/231 |
| 2002/0121213 | A1 * | 9/2002 | Micke et al. | 102/473 |
| 2003/0041767 | A1 * | 3/2003 | Rastegar et al. | 102/207 |
| 2003/0140811 | A1 * | 7/2003 | Bone | 102/266 |
| 2004/0031411 | A1 * | 2/2004 | Novotney et al. | 102/200 |
| 2005/0132920 | A1 * | 6/2005 | Ceola | 102/221 |
| 2006/0033406 | A1 * | 2/2006 | Rastegar et al. | 310/339 |
| 2006/0102040 | A1 * | 5/2006 | Johansson | 102/476 |
| 2006/0107862 | A1 * | 5/2006 | Davis et al. | 102/216 |
| 2009/0013891 | A1 * | 1/2009 | Rastegar et al. | 102/210 |
| 2010/0176692 | A1 * | 7/2010 | Shmilovich et al. | 310/339 |
| 2010/0282106 | A1 * | 11/2010 | Robinson et al. | 102/206 |
| 2012/0090490 | A1 * | 4/2012 | Pattison | 102/247 |

* cited by examiner

ADVANCED GRENADE CONCEPT WITH NOVEL PLACEMENT OF MEMS FUZING TECHNOLOGY

STATEMENT OF GOVERNMENT INTEREST

The present invention described herein may be manufactured and used by or for the Government of the United States of America for government purposes without the payment of any royalties thereon or therefore.

FIELD OF THE INVENTION

The present invention relates generally to explosive systems and micro-electromechanical systems (MEMS). More particularly, the present invention relates to systems and methods for explosive systems such as grenades with novel MEMS fuze and novel placement of the MEMS fuze providing increased performance, reliability, and safety.

BACKGROUND OF THE INVENTION

Conventionally, high velocity grenades rely on a mechanical impact fuze located in the front of the grenade. The mechanical impact fuze is a complex device that uses environmental parameters associated with gun launch (e.g., setback and spin) to arm. Upon impact with a target the nose of the mechanical impact fuze is crushed. This action projects a stabber into an explosive charge located at the base of the mechanical impact fuze. A charge detonates and launches a metal projectile towards a main charge, which then detonates upon impact. This action collapses a metal shaped charge liner, which is projected forward through the mechanical impact fuze and into the target. At the same time the main charge fragments the body of the grenade and throws those fragments outward.

There are several limitations with conventional systems. The mechanical impact fuze is a complex device that is prone to failure. It has been known to arm and detonate early, posing a hazard to the gunner. These failures have primarily been attributed to errors made during manufacturing. The mechanical impact fuze may also fail to fire if the weapon impacts at an oblique angle or hits soft material such as snow. This situation poses an unexploded ordnance hazard to operators and bystanders. In addition, the presence of the mechanical impact fuze in front of the shaped charge inhibits the ability of the weapon to penetrate armor. Before the shaped charge can penetrate the target it must first go through the steel and aluminum components of the mechanical impact fuze. Further, the rear of the fragmenting grenade body has a tendency to come off as a single piece and fly straight back, which is a hazard to the gunner. Finally the device does not meet Department of Defense (DOD) "Insensitive Munitions" requirements, which are standards designed to reduce of risk of injury to personnel as a result of accidents such as dropped items or a fire.

BRIEF SUMMARY OF THE INVENTION

In an exemplary embodiment, an explosive system includes a case with an interior with a front portion, a middle portion, and a rear portion; a main explosive charge disposed within the middle portion of the interior of the case; and a micro-electromechanical systems fuze disposed within the rear portion of the interior of the case, wherein the micro-electromechanical systems fuze is configured to detonate the main explosive charge and the micro-electromechanical systems fuze includes a plurality of safety mechanisms. The explosive system may further include a shaped charge liner disposed in the front portion of the interior of the case. The shaped charge liner is configured to penetrate a target upon detonation of the main explosive charge where the penetration is unimpeded by the micro-electromechanical systems fuze. The shaped charge liner is shaped to optimize penetration into the target. The case may include a fragmenting case configured to fragment upon detonation of the main explosive charge. The explosive system may further include electronic circuits disposed in the rear portion and communicatively coupled to the micro-electromechanical systems fuze; and an energy source powering the electronic circuits and the micro-electromechanical systems fuze. The energy source may include a piezoelectric energy harvester. The plurality of safety mechanisms may include a setback lock on the micro-electromechanical systems fuze, a timer in the electronic circuits configured to remove a command lock on the micro-electromechanical systems fuze, and sensors in the electronic circuits detecting impact and spinning of the explosive system. The setback lock is released upon launch of the explosive system, the command lock is removed upon expiration of the timer, and a micro-detonator on the micro-electromechanical systems fuze detonates the main explosive charge based upon the sensors detecting impact or cessation of the spinning. The micro-electromechanical systems fuze may include a spin armed slider; a command lock and a setback lock holding the spin armed slider in place; and an initiator out of line from a micro-detonator cup disposed to the spin arm slider. The explosive system may further include electronic circuits disposed in the rear portion and communicatively coupled to the micro-electromechanical systems fuze; where upon firing, the setback lock is moved out of position. The electronic circuits are configured to: activate a timer upon firing, release the command lock upon expiration of the timer, and detect spinning and impact of the explosive system. Upon release of the command lock and the setback lock, the spin armed slider moves into position such that the micro-detonator cup is in line with the initiator thereby arming the micro-electromechanical systems fuze.

In another exemplary embodiment, electronic circuitry for an explosive system includes electronic circuits disposed on a circuit board; a micro-electromechanical systems fuze including plurality of safety mechanisms, where the micro-electromechanical systems fuze is communicatively coupled to the electronic circuits; and an energy source powering the electronic circuits and the micro-electromechanical systems fuze. Each of the circuit board, the micro-electromechanical systems fuze, and the energy source are disposed in a rear portion of the explosive system. The energy source may include a piezoelectric energy harvester. The plurality of safety mechanisms may include a setback lock on the micro-electromechanical systems fuze, a timer in the electronic circuits configured to remove a command lock on the micro-electromechanical systems fuze, and sensors in the electronic circuits detecting impact and spinning of the explosive system. The setback lock is released upon launch of the explosive system, the command lock is removed upon expiration of the timer, and a micro-detonator on the micro-electromechanical systems fuze detonates a main explosive charge in the explosive system based upon the sensors detecting impact or cessation of the spinning. The micro-electromechanical systems fuze may include a spin armed slider; a command lock and a setback lock holding the spin armed slider in place; and an initiator out of line from a micro-detonator cup disposed to the spin arm slider. Upon firing, the setback lock is moved out of position where the electronic circuits are configured to activate a timer upon firing, release the command lock upon expiration of the timer, and detect spinning and impact of the explosive system. Upon release of the command lock and the setback lock, the spin armed slider moves into position such that the micro-detonator cup is in line with the initiator thereby arming the micro-electromechanical systems fuze.

In yet another exemplary embodiment, a method includes launching a round, wherein the round includes a micro-electromechanical systems fuze in a rear portion of the round after explosive charges; releasing a setback lock on the micro-electromechanical systems fuze upon launching; initiating a timer upon launching; releasing a command lock on the micro-electromechanical systems fuze based on the timer thereby allowing a micro-detonator on the micro-electromechanical systems fuze to slide into position; and detecting impact and detonating the round through the micro-detonator. The method may further include detecting no impact and detecting the round has stopped spinning and detonating the round through the micro-detonator.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

In various exemplary embodiments, the present invention relates to systems and methods for explosive systems such as grenades with novel MEMS fuze and novel placement of the MEMS fuze providing increased performance, reliability, and safety. The MEMS fuze is disposed towards a rear portion of the explosive system providing superior performance and design flexibility. Further, the explosive system includes electronics configured to implement a launch timer and to sense impact or when the system stops spinning. The present invention includes an operational method improving safety and reliability by preventing detonation until after the launch timer expires, upon impact, or when the explosive system stops spinning.

Figure 1:
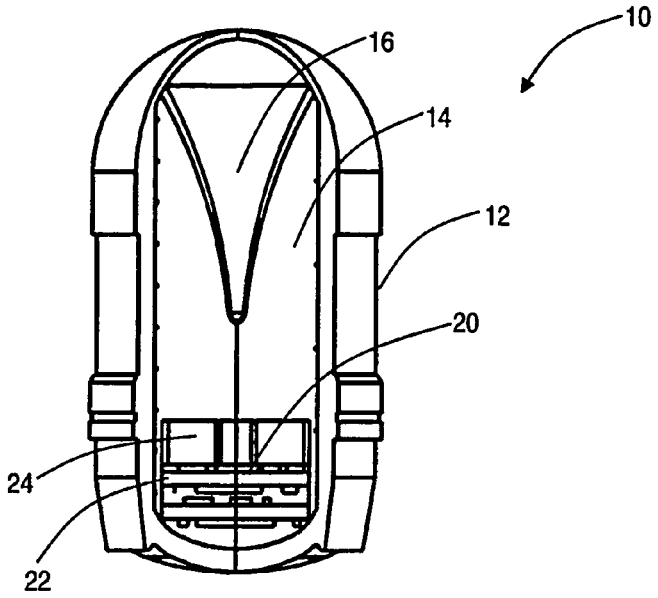
FIG. 1 is a front perspective, cut-out view of an explosive system according to an exemplary embodiment of the present invention.
Figure 2:
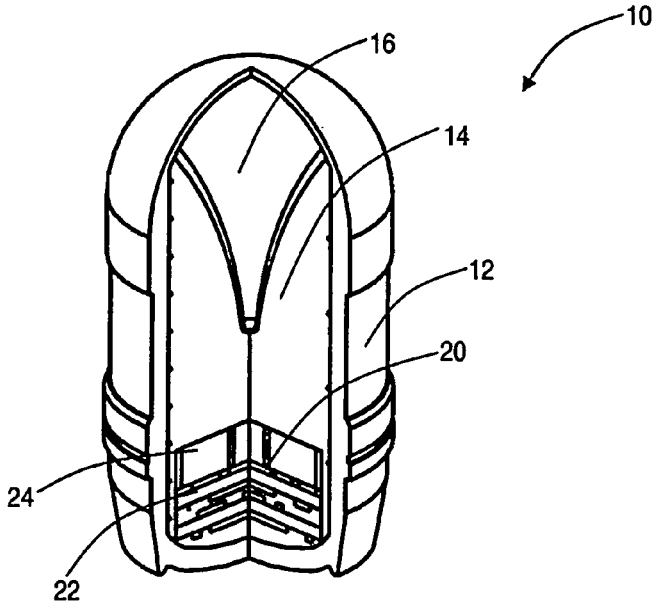
FIG. 2 is a diagonal perspective, cut-out view of the explosive system of FIG. 1 according to an exemplary embodiment of the present invention.
Figure 3:
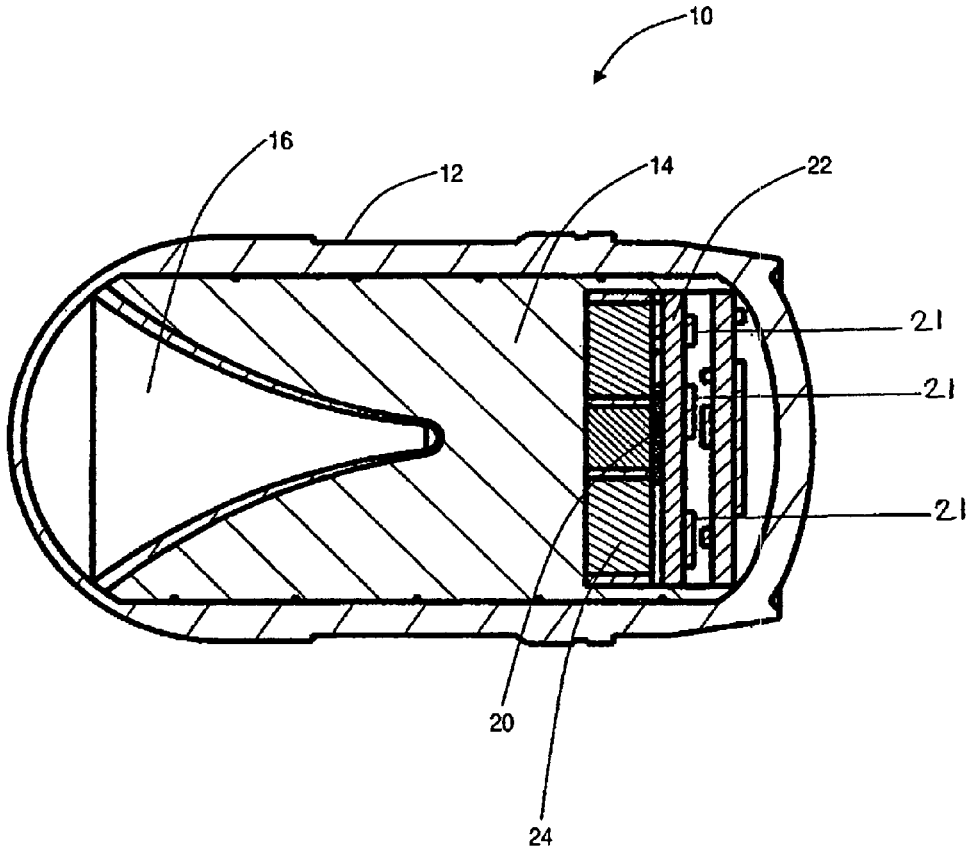
FIG. 3 is a cross-sectional view of the explosive system of FIG. 1 according to an exemplary embodiment of the present invention.

Referring to FIGS. 1-3, in an exemplary embodiment, an explosive system 10 is illustrated in a front perspective view (FIG. 1), a diagonal perspective view (FIG. 2) and a cross sectional view (FIG. 3). In an exemplary embodiment, the explosive system 10 may include a high explosive, dual purpose (HEDP), high velocity grenade. For example, HEDP grenades may be intended for use against personnel and lightly armored vehicles. The explosive system 10 includes a fragmenting case 12 designed to fragment upon detonation of a main explosive charge 14 disposed within an interior of the fragmenting case 12. The explosive system 10 further includes a shaped charge liner 16 disposed in front of the main explosive charge 14 and within the interior of the fragmenting case 12. The main explosive charge 14 and the shaped charge liner 16 may include various explosive materials and compounds as are known in the art. Upon detonation of the main explosive charge 14, the shaped charge liner 16 is configured to project forward and to penetrate into a target. In the examples of FIGS. 1-3, the shaped charge liner 16 is illustrated extending from a point near the center of the fragmenting case 12 interior with a parabolic, conical shape towards covering the entire front of the fragmenting case 12 interior. The present invention contemplates various geometries and material compositions of the shaped charge liner 16 as required for penetrating different target types and functioning in different weapon environments. The explosive system 10 spins while it flies in order to maintain ballistic stability. The shaped charge liner 16 may include spin compensation in order to counteract associated rotational forces. This compensation comes in the form of geometric changes (called fluting) or material changes. Different weapon systems may have different environmental parameters that the present invention accommodates.

In an exemplary embodiment of the present invention, the explosive system 10 includes a MEMS fuze 20 disposed towards a rear portion of the fragmenting case 12 interior. Specifically, the explosive system 10 may include a front portion with the shaped charge liner 16, a middle portion with the main explosive charge 14, and a rear portion with the MEMS fuze 20. Advantageously, placing the MEMS fuze 20 in the rear allows for greater design flexibility and optimization of penetration with the shaped charge liner 16. MEMS Fuze technology is being developed that requires less space and is more configurable than current technology. Specifically, the MEMS fuze 20 is disposed after the main explosive charge 14 and the shaped charge liner 16 relative to the front of the fragmenting case 12. Thus, the MEMS fuze 20 does not interfere with the shaped charge liner 16 upon impact. The explosive system 10 further includes circuit boards 22 with various electronic components related to operation of the explosive system 10. Also, the explosive system 10 includes an energy source 24 that powers the MEMS fuze 20 and the circuit boards 22 in the rear portion of the explosive system 10. For example, the energy source 24 may include a piezoelectric energy harvester. Note, the MEMS fuze 20, the circuit boards 22, and the energy source 24 may each be communicatively coupled for power and data transfer therebetween. The circuit boards 22 may include electronic components 21 configured to control the MEMS fuze 20, provide a timer, sense spinning of the explosive system 10, and sense impact of the explosive system 10. For example, the circuit boards 22 may control various components associated with or on the MEMS fuze 20, and the energy source 24 may power both the circuit boards 22 and the MEMS fuze 20.

Figure 4:
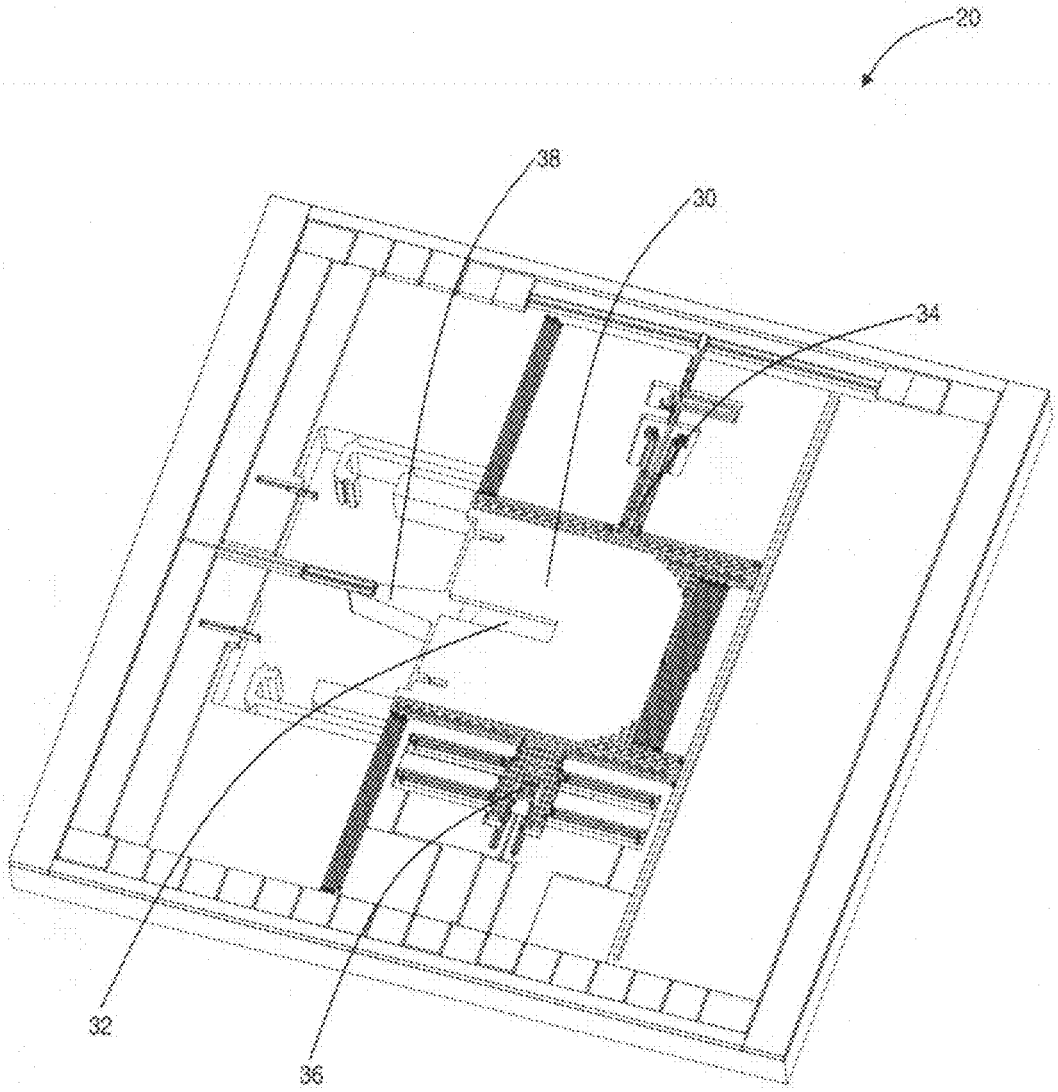
FIG. 4 is a top perspective view of a MEMS fuze for use in the explosive system of FIG. 1 according to an exemplary embodiment of the present invention.
Figure 5:
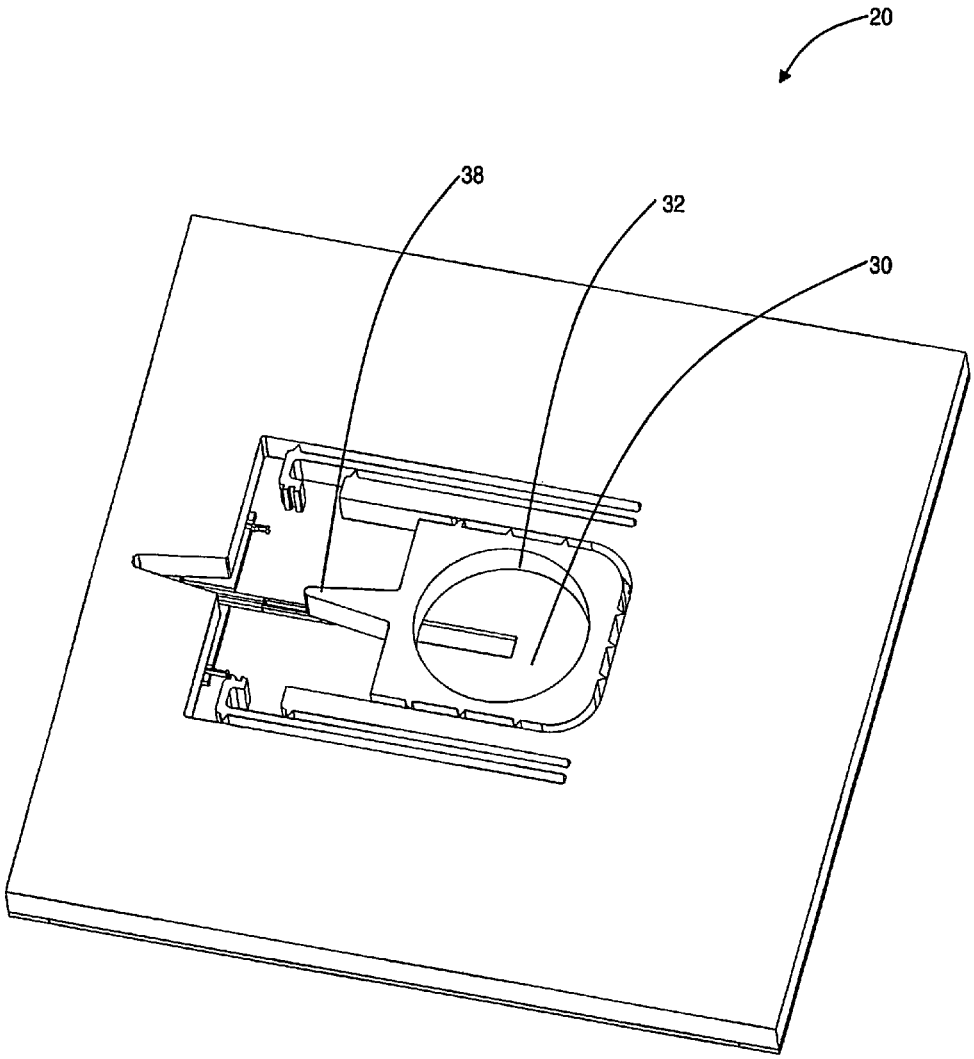
FIG. 5 is a bottom perspective view of a MEMS fuze for use in the explosive system of FIG. 1 according to an exemplary embodiment of the present invention.

Referring to FIGS. 4 and 5, in an exemplary embodiment, the MEMS fuze 20 is illustrated in a top perspective view (FIG. 4) and a bottom perspective view (FIG. 5). The MEMS fuze 20 includes a spin armed slider 30 (shown in FIG. 4) with a micro-detonator cup 32 (shown in FIG. 5). The micro-detonator cup 32 is disposed towards the center of the MEMS fuze 20 chip. The spin armed slider 30 is restrained from moving by a command lock 34 and a setback lock 36. An initiator 38 stands out of line from the micro-detonator cup 32. Upon firing, the force of gun launch moves the setback lock 36 out of position. At the same time, a sensor inside electronics on the circuit boards 22 activates a timer. After a prescribed period of time, the timer counts down and the electronics remove the command lock 34, allowing the spin armed slider 30 to move into position. Centrifugal force from rotation of the explosive system 10 moves the spin armed slider 30 such that the micro-detonator cup 32 is in line with the initiator 38. The MEMS fuze 20 is now armed. When the explosive system 10 hits a target, the electronics on the circuit boards 22 command the initiator 38 to fire, which detonates energetic material disposed inside the micro-detonator cup 32. This configuration causes the explosive system 10 to detonate. To reduce the risk of unexploded ordnance, the electronics on the circuit boards 22 may instruct the MEMS fuze 20 to fire once the round stops spinning. This situation occurs if the explosive system 10 fails to impact the target and subsequently lands on the ground.

The MEMS fuze 20 may be implemented through various mechanisms. For example, the MEMS fuze 20 may be fabricated on a silicon on insulator (SOD wafer. Here, a silicon substrate (also known as a handle layer) is covered by an insulating or intermediate layer, such as silicon dioxide, over which is bonded or deposited another silicon layer, also known as the device layer, which is the layer from which the MEMS fuze 20 assembly components are fabricated. The MEMS fuze 20 assembly components may be formed by a DRIE (deep reactive ion etching) process that removes unwanted portions of device layer. The DRIE process is a well developed micromachining process used extensively with silicon based MEMS devices. For this reason, silicon is an exemplary material for the MEMS fuze 20 assembly of the present invention, although other materials are possible. In other exemplary embodiments, materials other than silicon may be used as a substrate, including glass, stainless steel, and a plastic material, such as, polycarbonate.

Figure 6:
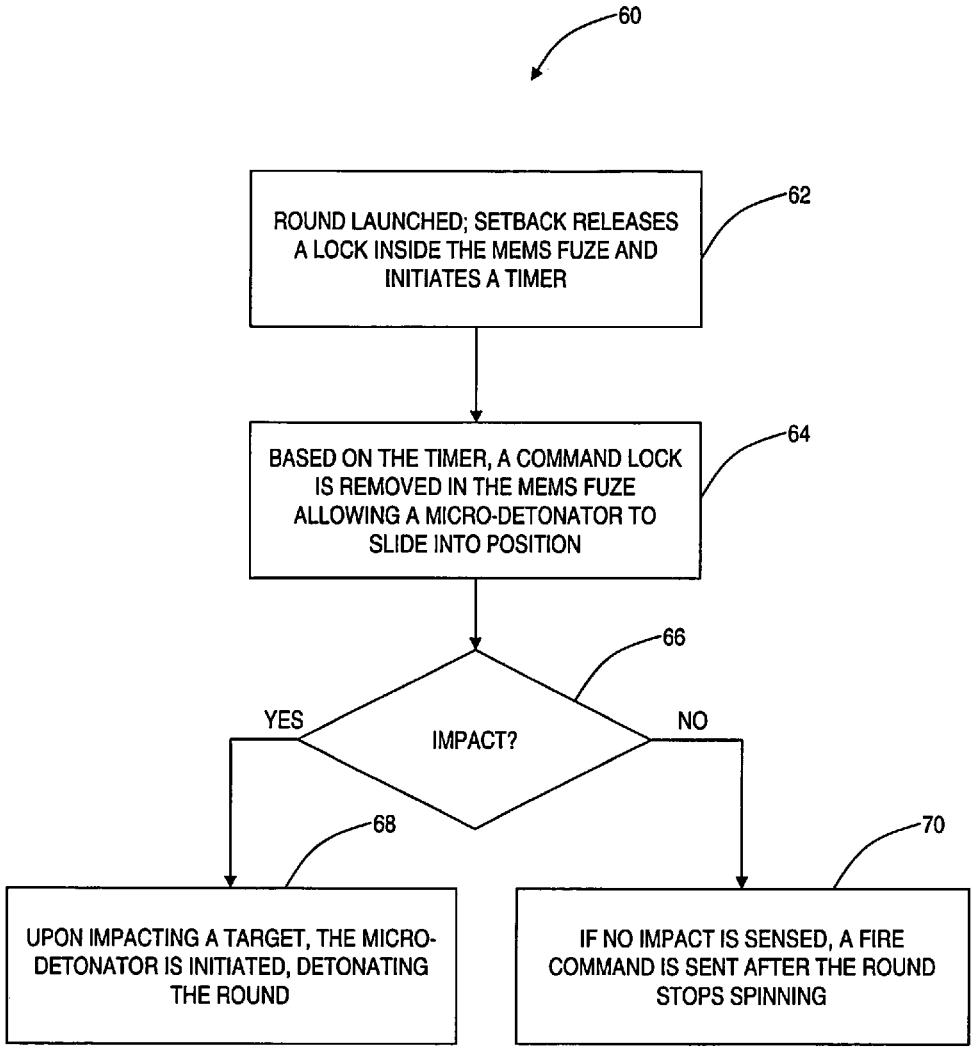
FIG. 6 is a flowchart of an operational method 60 utilizing the explosive system of FIGS. 1-3 and the MEMS fuze of FIGS. 4-5.

Referring to FIG. 6, in an exemplary embodiment, a flowchart illustrates an operational method 60 utilizing the explosive system 10 and the MEMS fuze 20. A round is launched and a setback in the round releases a lock inside the MEMS fuze and initiates a timer (step 62). Note, the round may include the explosive system 10, a grenade, or the like. The timer is set for a prescribed time period, and provides improved safety in preventing the round from detonating immediately upon launch. Based on the timer, a command lock is removed in the MEMS fuze allowing a micro-detonator to slide into position (step 64). In the operational method 60, the round is configured to sense an impact, such as through electronics disposed with the explosive system 10 (step 66). Upon impacting a target, the micro-detonator is initiated, detonating the round (step 68). As described herein, the explosive system 10 includes the MEMS fuze disposed towards the rear of the explosive system 10. As such, upon impact, the explosive system 10 provides a shaped charge jet from the front that penetrates the target since the fuze and electronics are not interfering with the front of the explosive system 10. Further, fragments from a casing associated with the explosive system 10 may serve in an anti-personnel function. If no impact is sensed by the round, a fire command is sent after the round stops spinning (step 70). For example, the electronics in the explosive system 10 may include sensors to detect when the round stops spinning. The fire command prevents unexploded ordinances.

The present invention provides several advantages over conventional designs, specifically in areas of performance, reliability, and safety. Moving the MEMS fuze to the rear of the round reduces the amount of material the shaped charge has to go through before it reaches the target resulting in better penetration. The fragmenting case is modified such that it will not project the rear of the body to the firer, improving safety. The explosive fill itself is changed to be more compliant with Insensitive Munition standards. The MEMS fuze has fewer moving parts than the current mechanical impact fuzes, and the tolerances are easier to control due to the batch process methods used to fabricate the components. This configuration improves reliability and reduces the likelihood of a premature detonation. Finally, the presence of an electronic fire control system reduces the likelihood of dud rounds.

In an exemplary embodiment, the explosive system 10 may include a 40×53 High-Velocity, High-Explosive Dual-Purpose (HEDP) M430 cartridge (subsequently replaced in production by the M430A1) or the like. Thus, the concepts described herein may enhance the safety and reliability of the M430A1 HEDP. It may also be applied to a wide variety of other small and medium caliber weapons. Advantageously, the present invention addresses the need for smaller and smarter weapons. Relocation of the fuze, combined with the MEMS technology, allows for significant optimization and configuration of weapons technology. The M430A1 provides both armor penetration and anti-personnel effects.

Although the present invention has been illustrated and described herein with reference to exemplary embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An explosive system, comprising:

a case comprising an interior with a front portion, a middle portion, and a rear portion;

a main explosive charge being disposed within the middle portion of the interior of the case;

a micro-electromechanical systems fuze disposed within the rear portion of the interior of the case;

circuit boards; and a piezoelectric energy source being situated substantially adjacent to the main explosive charge for detecting and harvesting energy based on a launch acceleration, wherein the piezoelectric energy source is communicatively coupled to the circuit boards and the micro-electromechanical systems fuze, wherein the micro-electromechanical systems fuze is configured, to detonate the main explosive charge, and wherein the micro-electromechanical systems fuze comprises a plurality of safety mechanisms, and wherein the micro-electromechanical systems fuze comprises a spin armed slider, a solely electronic command lock and a setback lock to hold the spin armed slider in place.

2. The explosive system of claim 1, further comprising a shaped charge liner being disposed in the front portion of the interior of the case.

3. The explosive system of claim 2, wherein the shaped charge liner is configured to penetrate a target upon detonation of the main explosive charge, and wherein penetration is unimpeded by the micro-electromechanical systems fuze.

4. The explosive system of claim 2, wherein the shaped charge liner is a conical shaped charge liner to optimize penetration into the target.

5. The explosive system of claim 1, wherein the case comprises a fragmenting case configured to fragment upon detonation of the main explosive charge.

6. The explosive system of claim 1, wherein the circuit boards comprise electronic components disposed in the rear portion and communicatively coupled to the micro-electromechanical systems fuze, and wherein the piezoelectric energy source powers the electronic components.

7. The explosive system of claim 6, wherein the plurality of safety mechanisms comprise the setback lock on the micro-electromechanical systems fuze, a timer in the circuit boards configured to remove the electronic command lock on the micro-electromechanical systems fuze, and the electronic components to detect impact and spin of the explosive system.

8. The explosive system of claim 6, wherein the plurality of safety mechanisms comprise a setback lock on the micro-electromechanical systems fuze, a timer in the circuit boards configured to remove a command lock on the micro-electromechanical systems fuze, and the electronic components sense impact and spin of the explosive system, and wherein the setback lock is released upon launch of the explosive system, the command lock is removed upon expiration of the timer, and a micro-detonator on the micro-electromechanical systems fuze detonates the main explosive charge based upon the electronic components sensing at least one of impact and cessation of the spinning.

9. The explosive system of claim 1, wherein the micro-electromechanical systems fuze comprises an initiator out of line from a micro-detonator cup disposed to the spin arm slider.

10. The explosive system of claim 9, wherein the circuit boards are disposed in the rear portion and the circuit boards are communicatively coupled to the micro-electromechanical systems fuze, wherein upon firing, the setback lock is moved out of position, wherein the circuit boards are configured to activate a timer upon firing; release the command lock upon expiration of the timer; and detect spinning and impact of the explosive system, and wherein upon release of the command lock and the setback lock, the spin armed slider moves into position such that the micro-detonator cup is in line with the initiator thereby to arm the micro-electromechanical systems fuze.

11. The explosive system of claim 1, wherein the micro-electromechanical systems fuze is comprised of silicon.

12. An explosive system, comprising:

electronic components being disposed on a circuit board;

a micro-electromechanical systems fuze comprising a plurality of safety mechanisms, wherein the micro-electromechanical systems fuze is communicatively coupled to the electronic components; and a piezoelectric energy source being situated substantially adjacent to a main explosive charge for detecting and harvesting energy based on a launch acceleration, wherein the piezoelectric energy source is communicatively coupled to the electronic components and the micro-electromechanical systems fuze, wherein each of the circuit board, the micro-electromechanical systems fuze, and the piezoelectric energy source are disposed in a rear portion of the explosive system, and wherein the micro-electromechanical systems fuze comprises a spin armed slider, a solely electronic command lock, and a setback lock to hold the spin armed slider in place.

13. The explosive system of claim 12, wherein the plurality of safety mechanisms comprise the setback lock on the micro-electromechanical systems fuze, a timer in the electronic components configured to remove the electronic command lock on the micro-electromechanical systems fuze, and sensors in the electronic components to detect impact and spin of the explosive system.

14. The explosive system of claim 13, wherein the setback lock is released upon launch of the explosive system, the electronic command lock is removed upon expiration of the timer, and a micro-detonator on the micro-electromechanical systems fuze detonates a main explosive charge in the explosive system based upon the sensors, which detect at least one of impact and cessation of the spin.

15. The explosive system of claim 12, wherein an initiator out of line from a micro-detonator cup disposed to the spin arm slider.

16. The explosive system of claim 15, wherein upon firing, the setback lock is moved out of position, wherein the electronic components are configured to activate a timer upon firing; release the electronic command lock upon expiration of the timer; and detect spin and impact of the explosive system, and wherein upon release of the electronic command lock and the setback lock, the spin armed slider moves into position such that the micro-detonator cup is in line with the initiator thereby to arm the micro-electromechanical systems fuze.

17. A method, comprising:

providing a round, and a micro-electromechanical systems fuze;

providing a piezoelectric energy source being acted upon by substantially adjacent components for powering the micro-electromechanical systems fuze;

wherein the piezoelectric energy source detects and harvests energy based on a launch acceleration launching a round, wherein the round comprises the micro-electromechanical systems fuze in a rear portion of the round after explosive charges;

releasing a setback lock on the micro-electromechanical systems fuze upon launching;

initiating a timer upon launching;

releasing a command lock on the micro-electromechanical systems fuze based on the timer thereby allowing a micro-detonator on the micro-electromechanical systems fuze to slide into position; and detecting impact and detonating the round through the micro-detonator wherein the micro-electromechanical systems fuze comprises a spin armed slider, a solely electronic command lock, and the setback lock to hold the spin armed slider in place.

18. The method of claim 17, further comprising detecting no impact and detecting the round has stopped spinning and detonating the round through the micro-detonator.

* * * * *